US007458389B2

(12) United States Patent
Doverspike

(10) Patent No.: US 7,458,389 B2
(45) Date of Patent: Dec. 2, 2008

(54) BRACKET SYSTEM FOR SECURING A SINGLE-LEVER-VALVES AND ASSOCIATED WATER PIPEWORK TO A SUPPORT BOARD

(76) Inventor: Mark Doverspike, P.O. Box 69808, Odessa, TX (US) 79763

( * ) Notice: Subject to any disclaimer, the term of this patent is extended or adjusted under 35 U.S.C. 154(b) by 607 days.

(21) Appl. No.: 11/184,778

(22) Filed: Jul. 20, 2005

(65) Prior Publication Data

US 2005/0251908 A1 Nov. 17, 2005

Related U.S. Application Data

(63) Continuation-in-part of application No. 11/108,837, filed on Apr. 19, 2005.

(60) Provisional application No. 60/563,005, filed on Apr. 19, 2004.

(51) Int. Cl.
*E03C 1/042* (2006.01)

(52) U.S. Cl. ..... 137/360; 4/695; 285/64; 248/57; 248/68.1

(58) Field of Classification Search ..... 137/360; 4/695; 285/64; 248/56, 57, 68.1, 70, 74; 52/34

See application file for complete search history.

(56) References Cited

U.S. PATENT DOCUMENTS

| | | | |
|---|---|---|---|
| 5,524,727 | A | 6/1996 | Yennie, Jr. |
| 5,906,080 | A | 5/1999 | diGirolamo et al. |
| 6,640,357 | B1 | 11/2003 | Chang |
| 6,666,419 | B1 | 12/2003 | Vramej |

*Primary Examiner*—John Fox
(74) *Attorney, Agent, or Firm*—Christopher Wood; Wood & Eisenberg, PLLC

(57) ABSTRACT

A bracket system for securing one or two single-lever-valves and associated water pipes to a support board. In one embodiment of the invention, a bracket system includes first and second female tongues, and a male tongue. The female and male tongues work can be orientated to cooperatively attach two single-lever-valves back to back to a support board.

3 Claims, 20 Drawing Sheets

BRACKET SYSTEM FOR SECURING A SINGLE-LEVER-VALVES AND ASSOCIATED WATER PIPEWORK TO A SUPPORT BOARD

CROSS-REFERENCE TO RELATED APPLICATIONS

The present application is a continuation-in-part application of U.S. patent application Ser. No. 11/108,837, filed Apr. 19, 2005, which in turn claims the benefit of priority from U.S. Provisional Patent Application Ser. No. 60/563,005, filed Apr. 19, 2004, with regard to which patent application Ser. Nos. 11/108,837 and 60/563,005 are incorporated herein by reference in their entirety.

STATEMENT REGARDING FEDERALLY SPONSORED RESEARCH OR DEVELOPMENT

Not Applicable.

FIELD OF THE INVENTION

The present invention relates generally to shower, tub, and/or tub & shower units. More specifically, the invention is directed to a bracket system for securing one or two single-lever-valves and associated water pipes to a support board.

BACKGROUND OF THE INVENTION

New housing, apartment or condo construction and/or remodeling projects require a lot of labor hours and materials. Installing or replacing shower, tub, or shower & tub units frequently involve different skilled workers. For example, architects may provide drawings that include shower, tub, or shower & tub units, which skilled plumbers install in accordance with the architects drawings.

The current trend is for esthetically pleasing shower, tub, or shower & tub units that are fitted with single-lever-valve systems that are hidden from view. However, contemporary shower, tub, or shower & tub designs are often fraught with narrow tolerances that make installing the single-lever-valve difficult.

Therefore, a need exists for efficient and safe-ways of installing single-level-valves out of sight of the user.

SUMMARY OF THE INVENTION

A bracket system for securing one or two single-lever-valves and associated water pipes to a support board. In one embodiment of the invention, a bracket system 100' comprises female tongues 1900*a* and 1900*b*, and a male tongue 1920. The female and male tongues work cooperatively to attach two single-lever-valves back to back to a support board.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a bracket system for securing one or two single-lever-valves and associated water pipes to a support board located inside a wall.

The numeral 100 denotes the bracket system of the present invention; alphanumerical labels such as 100*a*, 100*b*, and 100*c* represent derivatives or different embodiments thereof.

Figure 1:
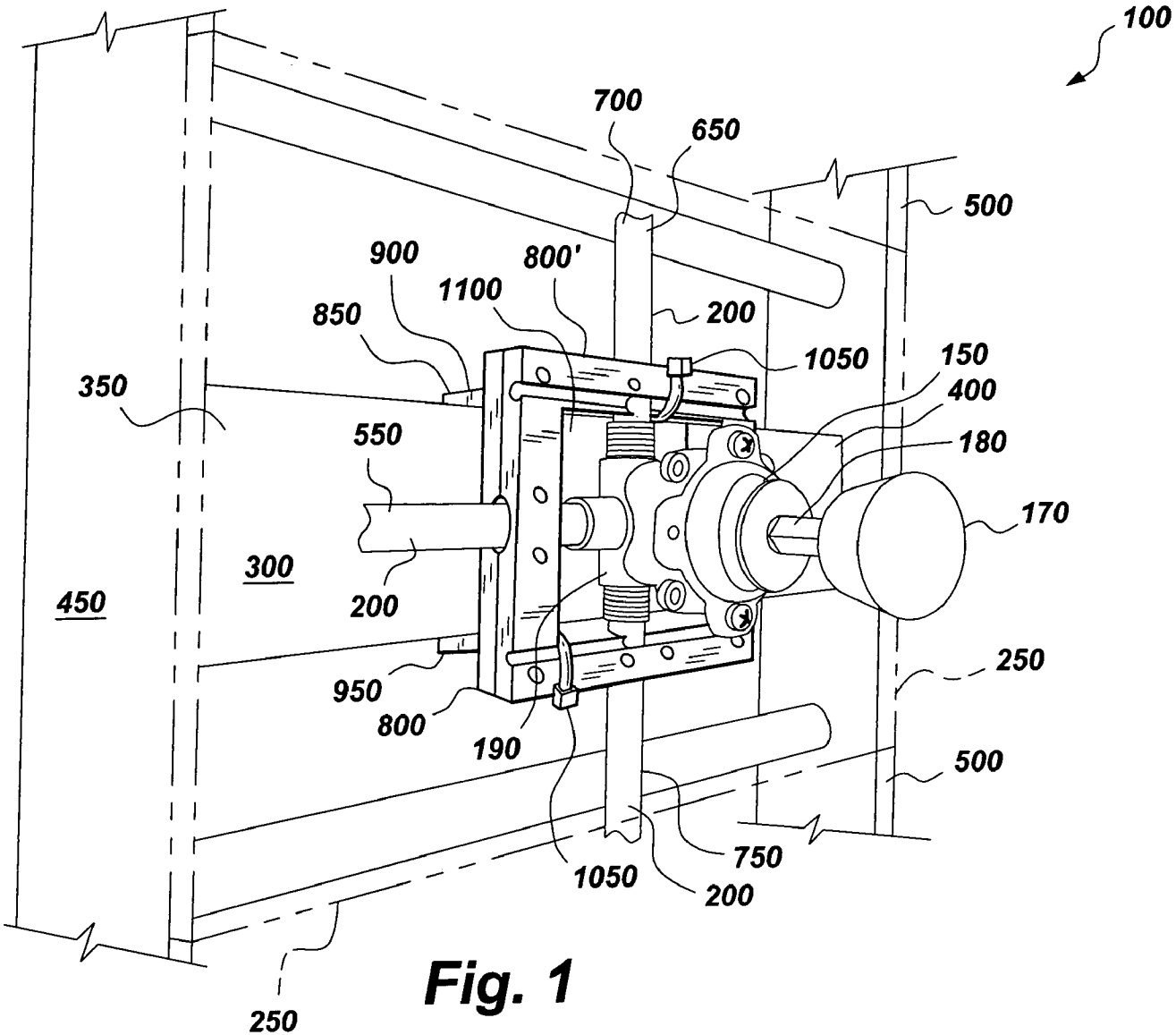
FIG. 1 shows an environmental, perspective view of a first embodiment of a bracket system according to the present invention.

FIG. 1 shows an environmental, perspective view of a first embodiment of the present invention. Specifically, the bracket system 100 anchors or secures a first single-lever-valve 150 and associated water pipe hardware 200 inside a wall 250. More specifically, the bracket system 100 anchors or secures first single-lever-valve 150 and water piping 200 to a support board 300 located inside wall 250 and with opposite ends 350 and 400 attached respectively to first and second vertical wall studs 450 and 500. The single-lever-valve 150 is operated by handle member 170 via stem 180, which is operably connected to the single-lever-valve 150. The single-lever-valve 150 includes or is operatively connected to a pipe inter-connector member 190, which in turn is in operable communication with associated water pipe hardware 200.

Although vertical studs 450 and 500 are shown in FIG. 1, it should be understood that the bracket system 100 could instead be mounted to a vertical support board, such as a support board mounted between two horizontal studs. The bracket system 100 can be made of any suitable material such as wood, metal, or resilient plastic, or combinations thereof.

The bracket system 100 of the present invention, and embodiments thereof as described herein, is not limited to securing one type of single-lever-valve inside a wall. Non-limiting examples of single-lever-valves include single-lever-valves such as those supplied by the Delta Faucet Company of 55 East 111th Street, PO Box 40980, Indianapolis, Ind. 46280, Moen, Inc. of 25300 Al Moen Drive, North Olmsted, Ohio 44070-8022, Kohler of 444 Highland Drive, Kohler, Wis. 53044, and B & K Faucets, Jacobsen Inc., PO Box 27, Adair, Iowa 50002. Examples of Delta single-lever-valves include the "Monitor 1300" (such as the 1303, 1303WS, and part 1304). Examples of Moen single-lever-valves include the Monticello (Model #: T3129 or T2449). Examples of Kohler single-lever-valves include the K-T6900-2, KT6900-4, K-T6902-2, and K-T6902-4. An example of the Jacobsen, Inc. single-lever-valve, which can be secured using the bracket system 100 of the present invention, includes item #: 121-204. Other non-limiting examples of single-lever-valves that can be secured by the present invention include those used in the Symmons Shower Systems such as model #s: 76-1, 76-1-BRS, and the 76-1-PCB. Still other non-limiting examples of single-lever-valves that can be secured by the present invention include those used in the Sepco Tube & Shower units such as the SEPCO22.

The bracket system 100 also secures the associated water pipe hardware 200 to the support board 300. The associated water pipe hardware 200 typically comprises hot and cold-water supply pipes 550 and 600 (hidden in FIG. 1, but visible in, e.g., FIG. 2C), and at least one water outlet pipe 650. In FIG. 1, the at least one outlet pipe 650 is represented by water outlet pipes 700 and 750. Hot and cold water inlets 550 and 600, and outlets 700 and 750 are thus arranged in a quadrangular pattern. The outlet 700 is typically connected at another end thereof with a showerhead (not shown). Outlet 750 is connected at another end thereof with, for example, a tub spout (not shown). However, at least one water outlet pipe 650 can be a single outlet pipe such as 700 or 750 such that the hot and cold-water supply pipes 550 and 600, and outlets 700 or 750 fan out in three directions as shown in FIG. 2E and accompanying description.

Still referring to FIG. 1, bracket system 100 comprises a first base bracket member 800, at least one board attachment bracket 850 (represented in FIG. 1 by first attachment bracket 900 and second attachment bracket 950), and a complementary first top bracket member 800'. The associated pipe hardware 200 (and the single-lever-valve 150 connected to the associated hardware via member 190) are held in place between first base bracket member bracket 800 and first top bracket member 800'. Optional clasps 1050 can be used to keep the brackets 800 and 800' in a tight fit around the associated pipe hardware 200. The sides of brackets 800 and 800' define a space 1100 for accommodating the hardware member 190 (and hence single-lever-valve 150).

Figure 2A:
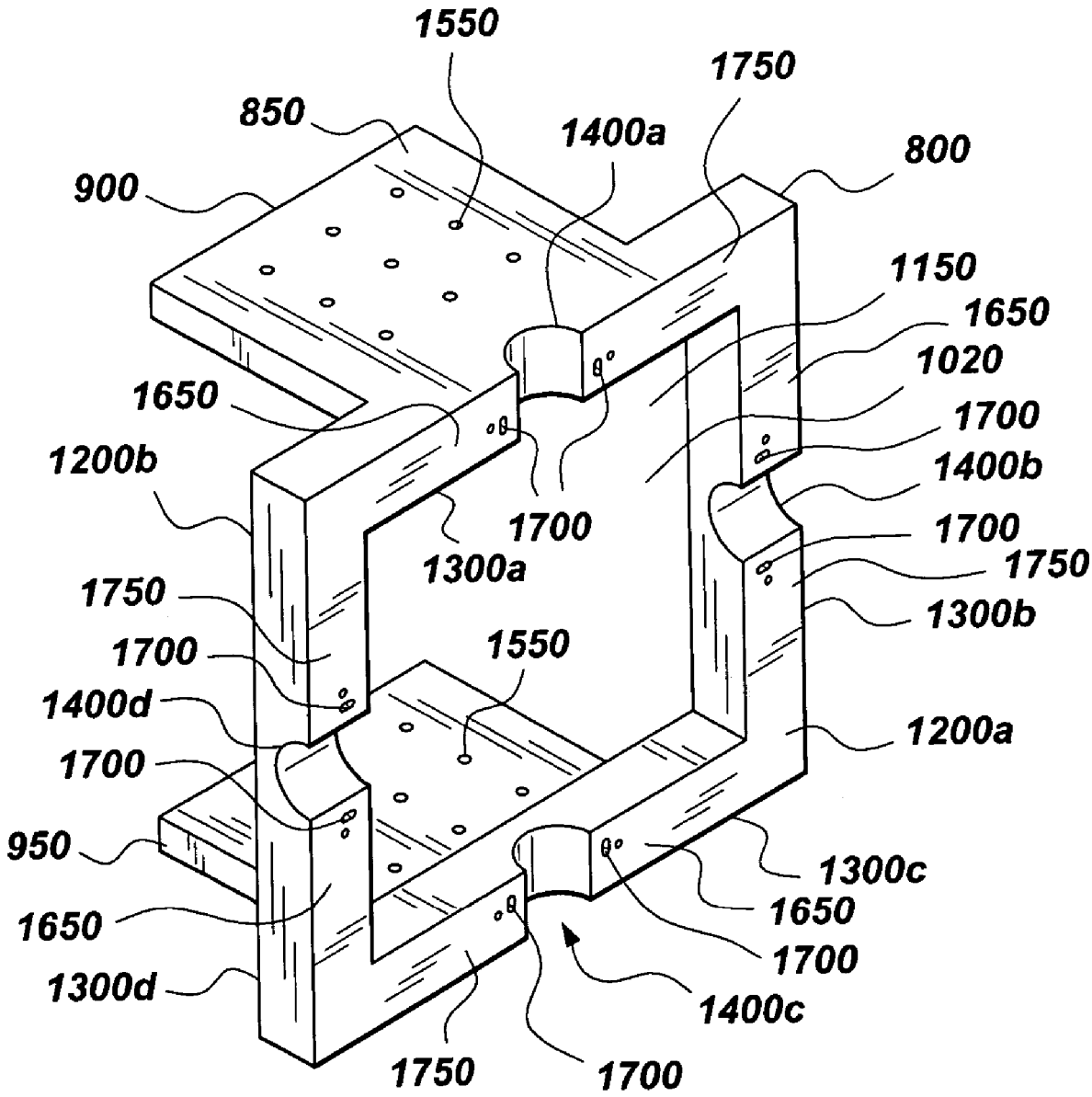
FIG. 2A shows a perspective view of a base bracket member, which forms part of the bracket system shown in FIG. 1.

Referring to FIG. 2A, which shows a perspective view of the base bracket member 800, which forms part of the bracket system 100 as shown in FIG. 1. The bracket 800 is of generally planar configuration having first 1200*a* and second 1200*b* opposite faces, and a first 1300*a*, second 1300*b*, third 1300*c*, and fourth 1300*d* sides that collectively define first central space 1000, here in the form of first central aperture 1020, for accommodating first single-lever-valve 150 or pipe inter-connector member 190 thereof. First 1300*a* and third 1300*c* sides are parallel and opposite each other, and second 1300*b* and fourth 1300*d* sides are parallel and opposite each other. First 1300*a*, second 1300*b*, third 1300*c*, and fourth 1300*d* sides respectively define first 1400*a*, second 1400*b*, third 1400*c*, and fourth 1400*d* notches in first face 1200*a*. Notches 1400*a* and 1400*c* are opposite each other and commonly aligned; notches 1400*b* and 1400*d* are opposite each other and commonly aligned.

Figure 6:
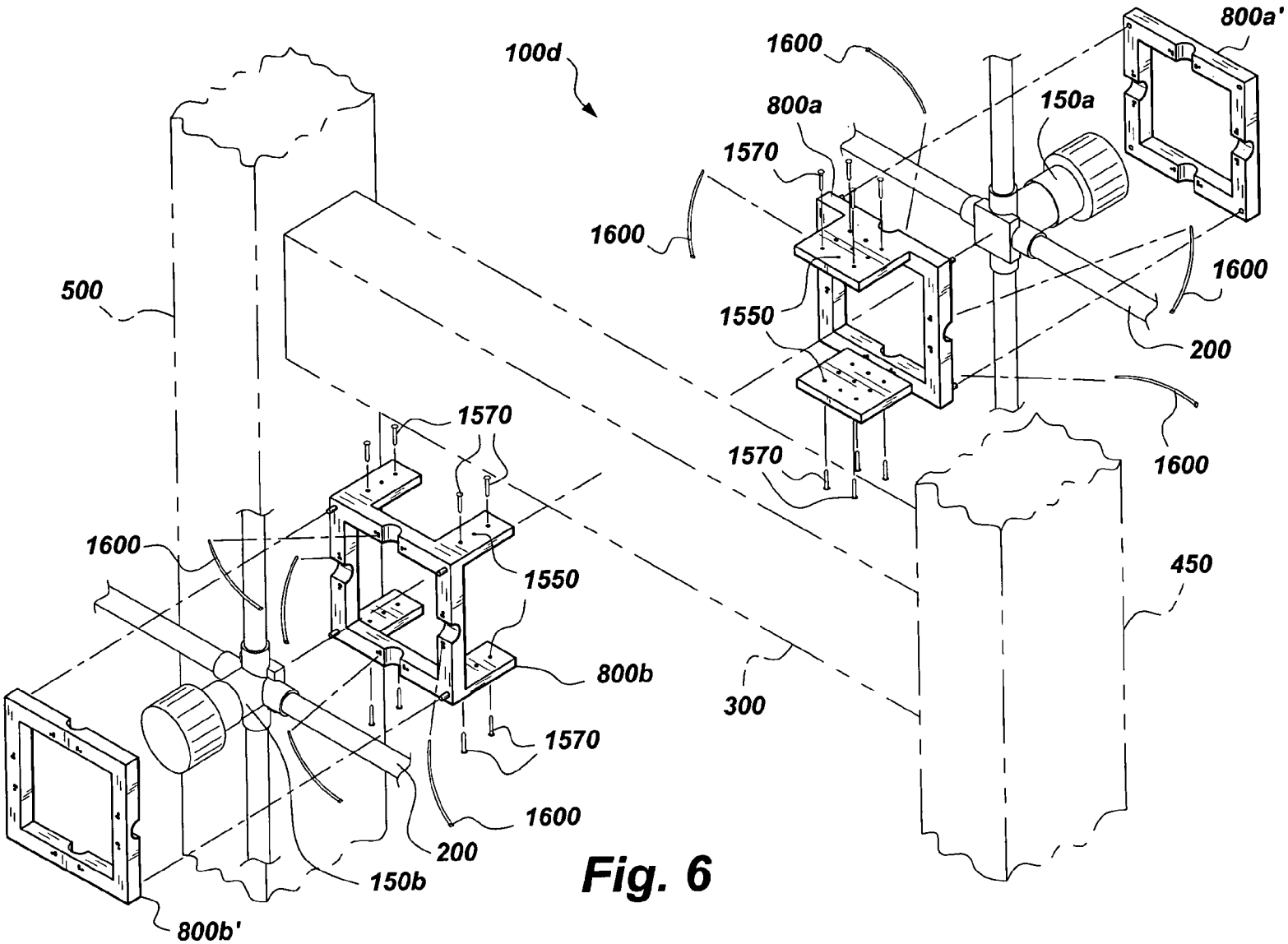
FIG. 6 shows an exploded view of another aspect of the present invention.

Still referring to FIG. 2A, while each of the notches 1400*a*, 1400*b*, 1400*c*, and 1400*d* is shown having a curved shape to accommodate part of the circumference of a water pipe. However, it should be understood that the notches 1400*a* through to 1400*d* can be any suitable recessed shape such as, but not limited to, a square, v-shaped, or rectangular shaped cutout, or combinations thereof. Attachment brackets 850 and 900 define board-securing apertures 1550 through which board attachment members 1570 (see, e.g., FIG. 6) affix bracket member 800 to support board 300.

Figure 2B:
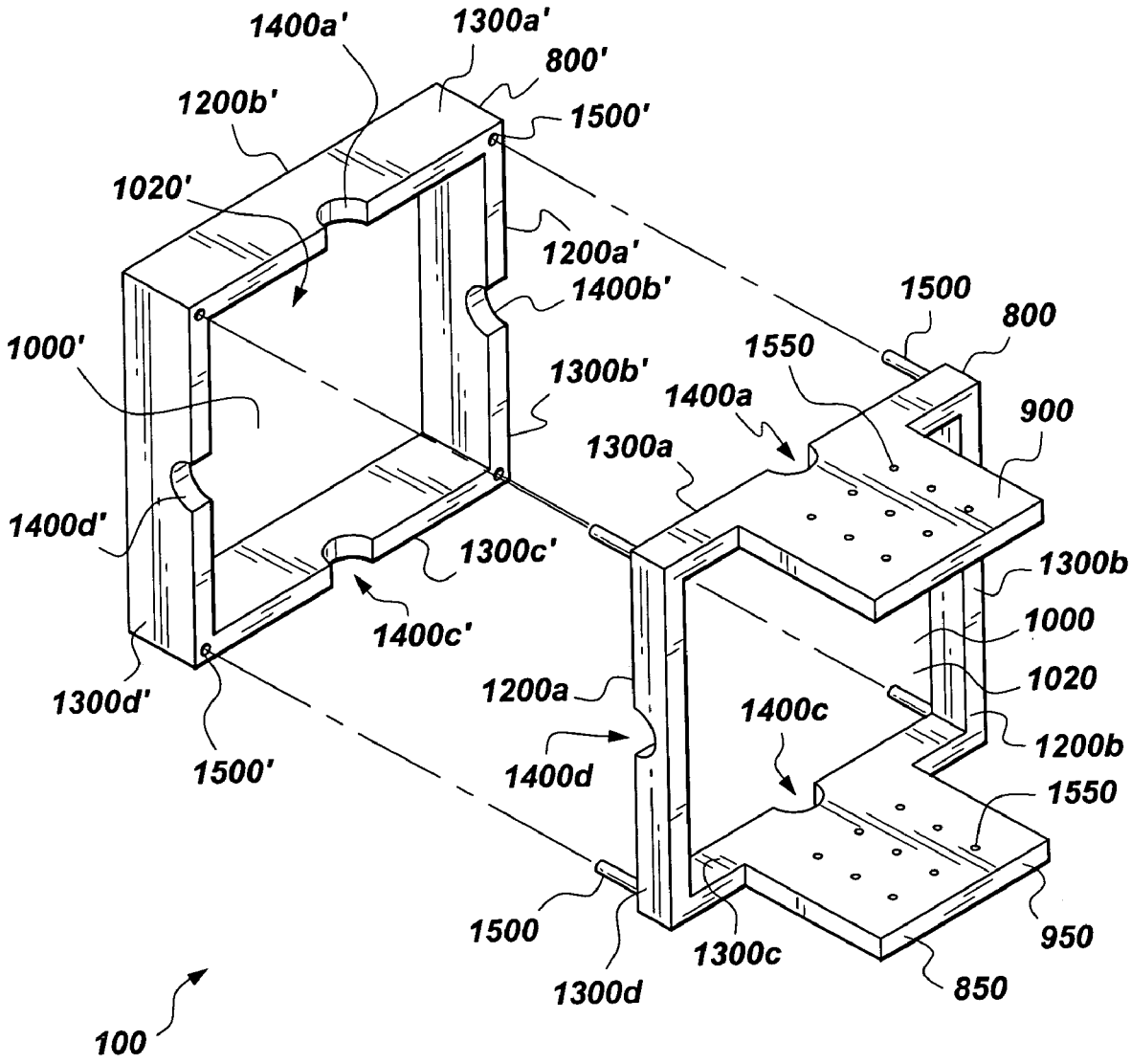
FIG. 2B shows an exploded, perspective view of the bracket system shown in FIG. 1.

FIG. 2B shows an exploded, perspective view of the bracket system 100 shown in FIG. 1. The bracket system comprises first base bracket member 800 of generally planar configuration, and a complementary first top bracket member 800'. The complementary first top bracket member 800' comprises first and second opposite faces 1200*a*' and 1200*b*', and fifth, sixth, seventh and eighth sides: 1300*a*', 1300*b*', 1300*c*' and 1300*d*', respectively. Sides 1300*a*', 1300*b*', 1300*c*' and 1300*d*' in turn respectively define therein first complementary or mirror notch 1400*a*', second complementary or mirror notch 1400*b*', third complementary or mirror notch 1400*c*' and fourth complementary or mirror notch 1400*d*' on complementary face 1200*a*', and a second central space 1000' in the form of a second central aperture 1020' to accommodate first single-lever-valve 150. The complementary mirror notches 1400*a*', 1400*b*', 1400*c*' and 1400*d*' align with notches 1400*a*, 1400*b*, 1400*c* and 1400*d*. The defined spaces 1000 and 1000' collectively equate to first central space 1100 shown, for example, in FIG. 1; and first and second apertures 1020 and 1020' collectively equate to first central aperture 1100 shown, for example, in FIG. 1.

Still referring to FIG. 2B, first base and first top bracket members 800 and 800'comprise a mechanism for securing or attaching first base and first top bracket members 800 and 800' together thereby providing the capability to hold first single-lever-valve 150 and associated pipe system 200 in place and secured against the support board 300 as shown in FIG. 1. The mechanism for securing or attaching first base and first top bracket members 800 and 800' together includes a plurality of male attachment pegs 1500 at various locations on face 1200*a* and corresponding female plug inserts 1500' at corresponding locations on face 1200*a*' of the top bracket 800'. Clasps 1050 can be used to keep the brackets 800 and 800' in a tight fit around the associated pipe hardware 200 (see FIG. 1). Attachment brackets 850 and 900 define board-securing apertures 1550 through which board attachment members 1570 (see, e.g., FIG. 6) affix bracket member 800 (and in this embodiment top bracket 800') to board 300.

Figure 2C:
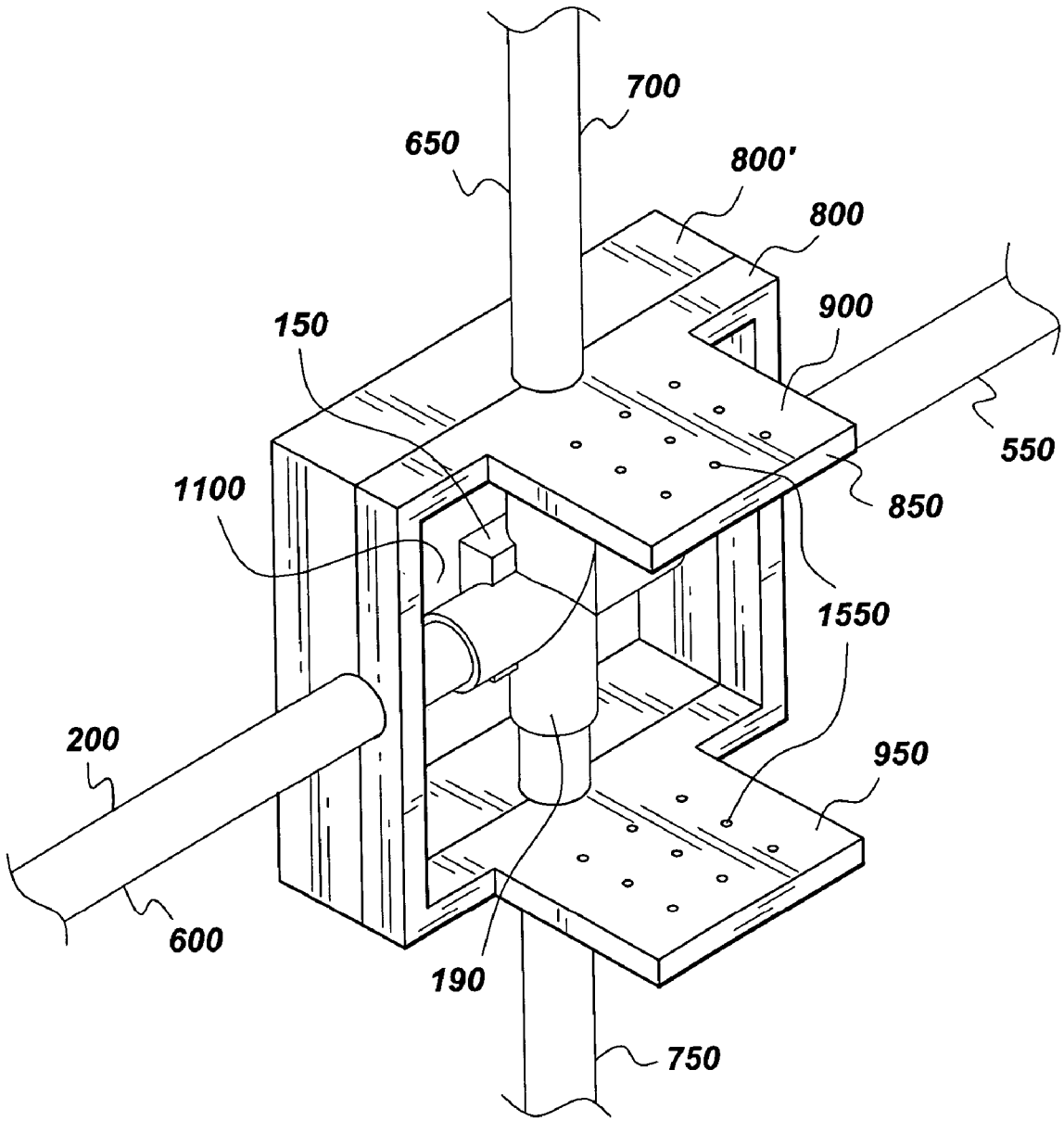
FIG. 2C shows a pair of brackets that forms part of the bracket system shown in FIG. 2B.

FIG. 2C shows the brackets 800 and 800' of FIG. 2B brought together around associated pipe hardware 200. Board attachment members 1570 (shown in FIG. 6), such as, but not limited to, screws, nails, pins, tacks, can be driven through apertures 1550 to attach bracket system 100 to support board 300 (shown in, e.g., FIG. 1).

Figure 2D:
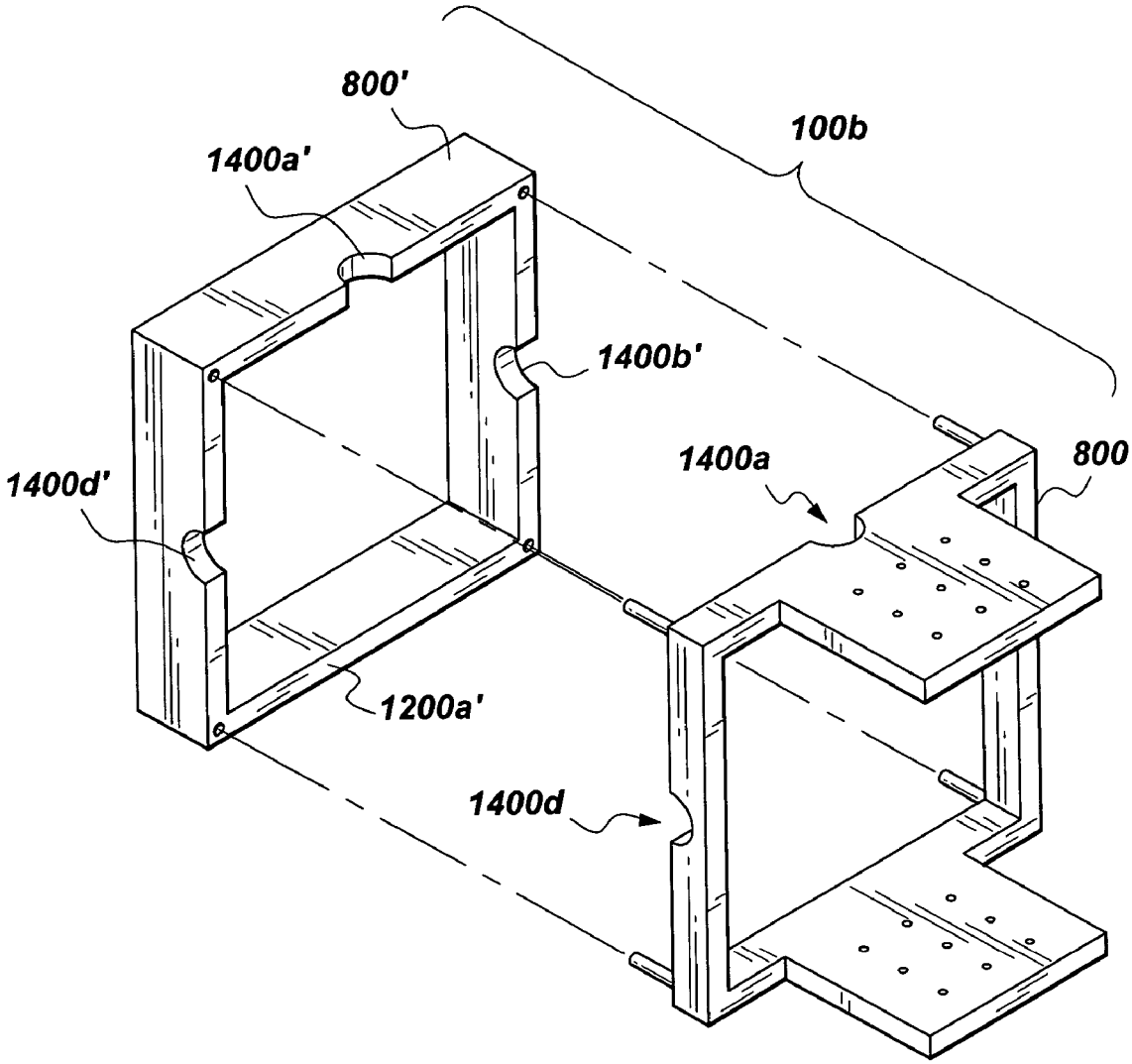
FIG. 2D shows a perspective view of a further embodiment of the bracket system of the present invention.
Figure 2E:
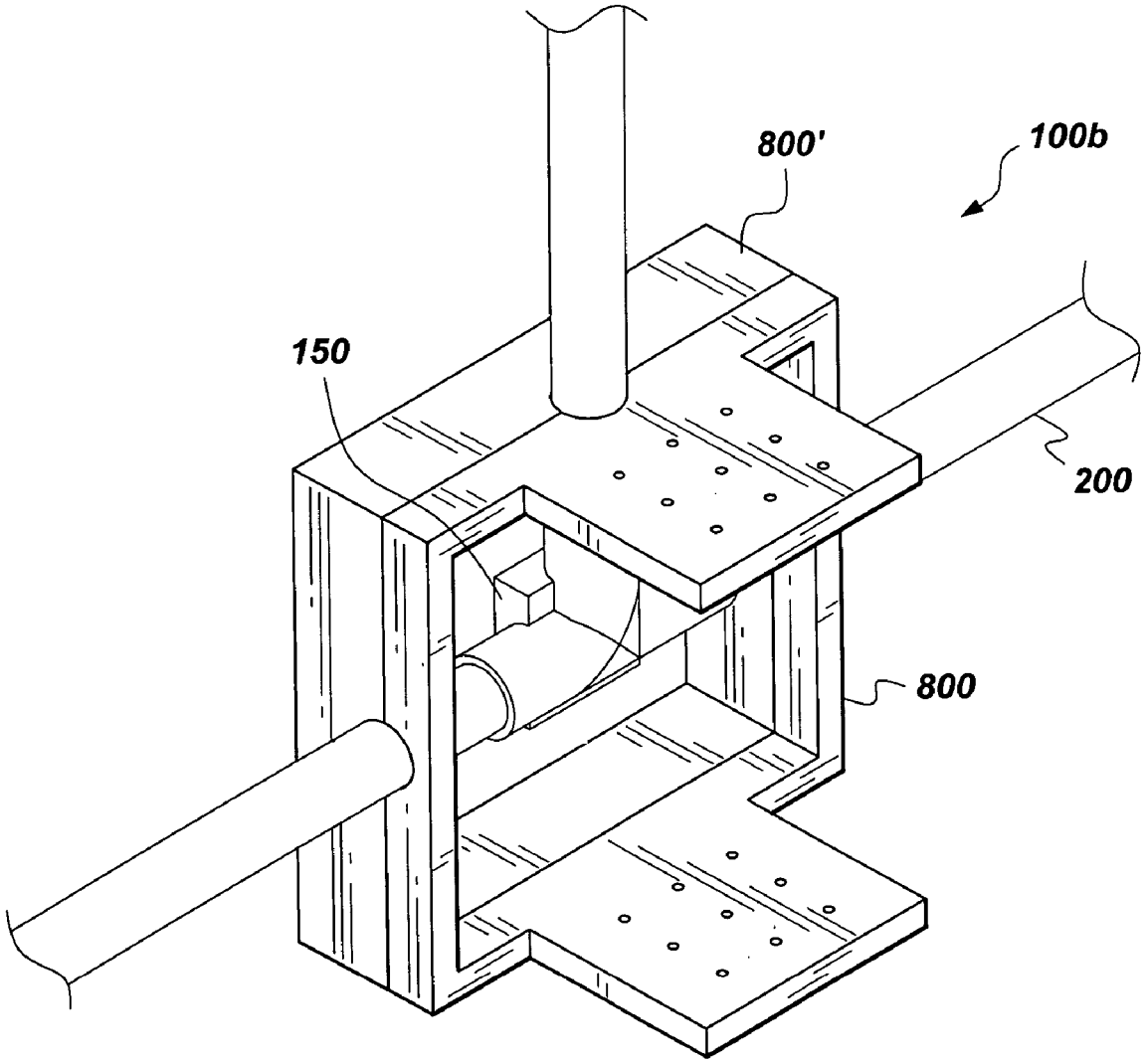
FIG. 2E shows base and top brackets secured to each other thereby enclosing water system hardware and a single-lever-valve.

Referring to FIGS. 2D and 2E, FIG. 2D shows a perspective view of a further embodiment of the bracket system 100 (represented by the alpha-numeric label 10*b*), which includes first base bracket 800 and first top bracket 800' fitted respectively with male plugs 1500 and female plug inserts 1500'. Three notches, 1400*a*, 1400*b* (not shown), and 1400*d* are located on face 1200*a* of base bracket 800, and three corresponding notches 1400*a*', 1400*b*' and 1400*d*' on face 1200*a*' of top bracket 800'. FIG. 2E shows brackets 800 and 800' of FIG. 2D secured to each other and thereby enclosing water system 200 and single-lever-valve 150. In this example, the brackets 800 and 800' comprise three complementary notch pairs 1400*a* and 1400*a*', 1400*b* and 1400*b*', and 1400*d* and 1400*d*'.

It should be understood that male plugs 1500 and female plug inserts 1500' can be fitted in reverse, i.e., the first base bracket 800 and first top bracket 800' are fitted respectively with female plug inserts 1500' and male plugs 1500.

Likewise with respect to all the embodiments of the invention such as, but not limited to, brackets system 100' described below.

Figure 2F:
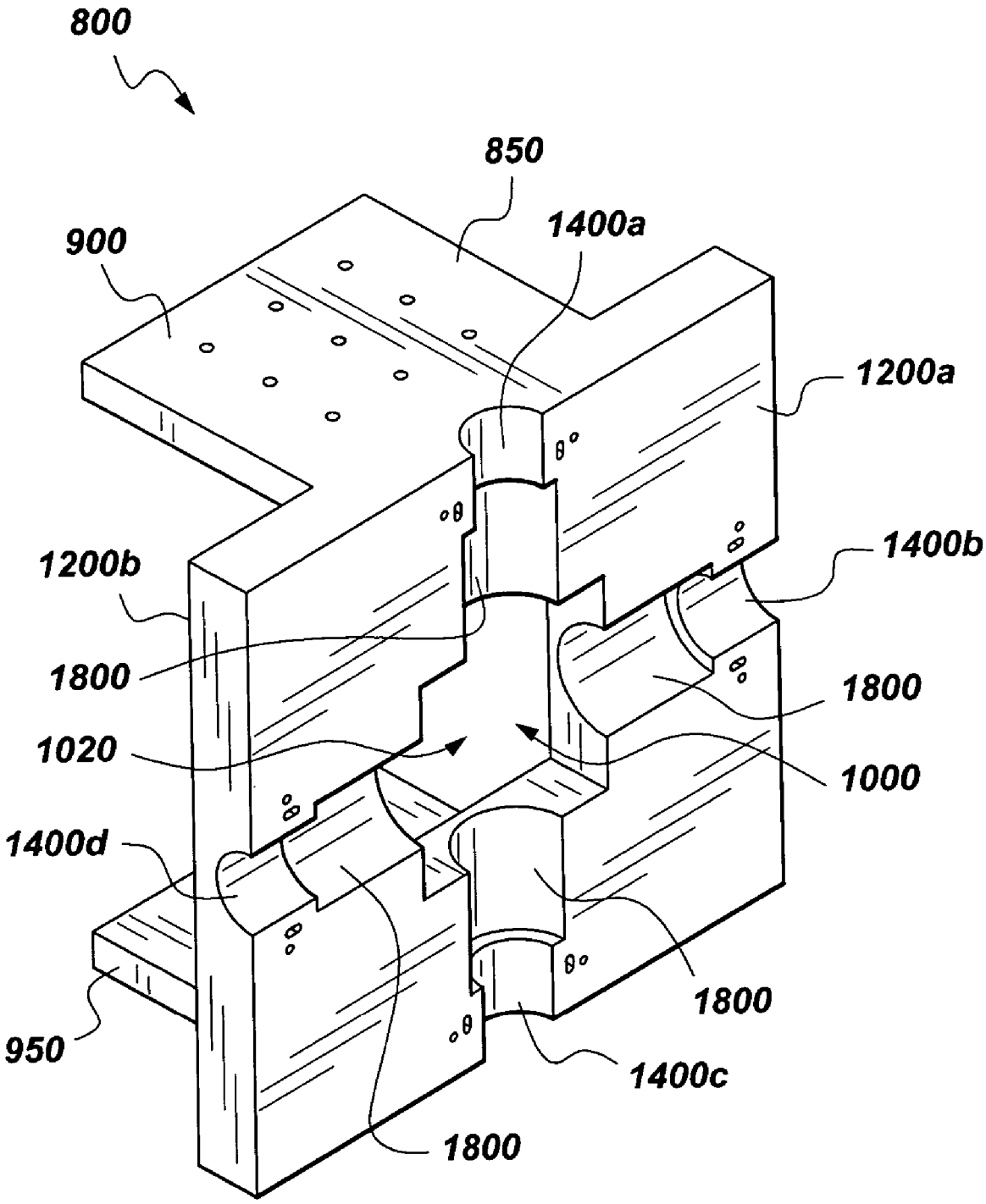
FIG. 2F shows another aspect of the present invention.

FIG. 2F shows yet another version of base bracket 800 in which first, second, third and fourth notches 1400*a*, 1400*b*, 1400*c*, and 1400*d* are etched out of face 1200*a* of base bracket 800. In addition, deeper grooves 1800 are formed in the face 1200*a* to provide a more custom fit for accommodating pipe inter-connector member 190, which typically forms part of a single-lever-valve 150.

Figure 3:
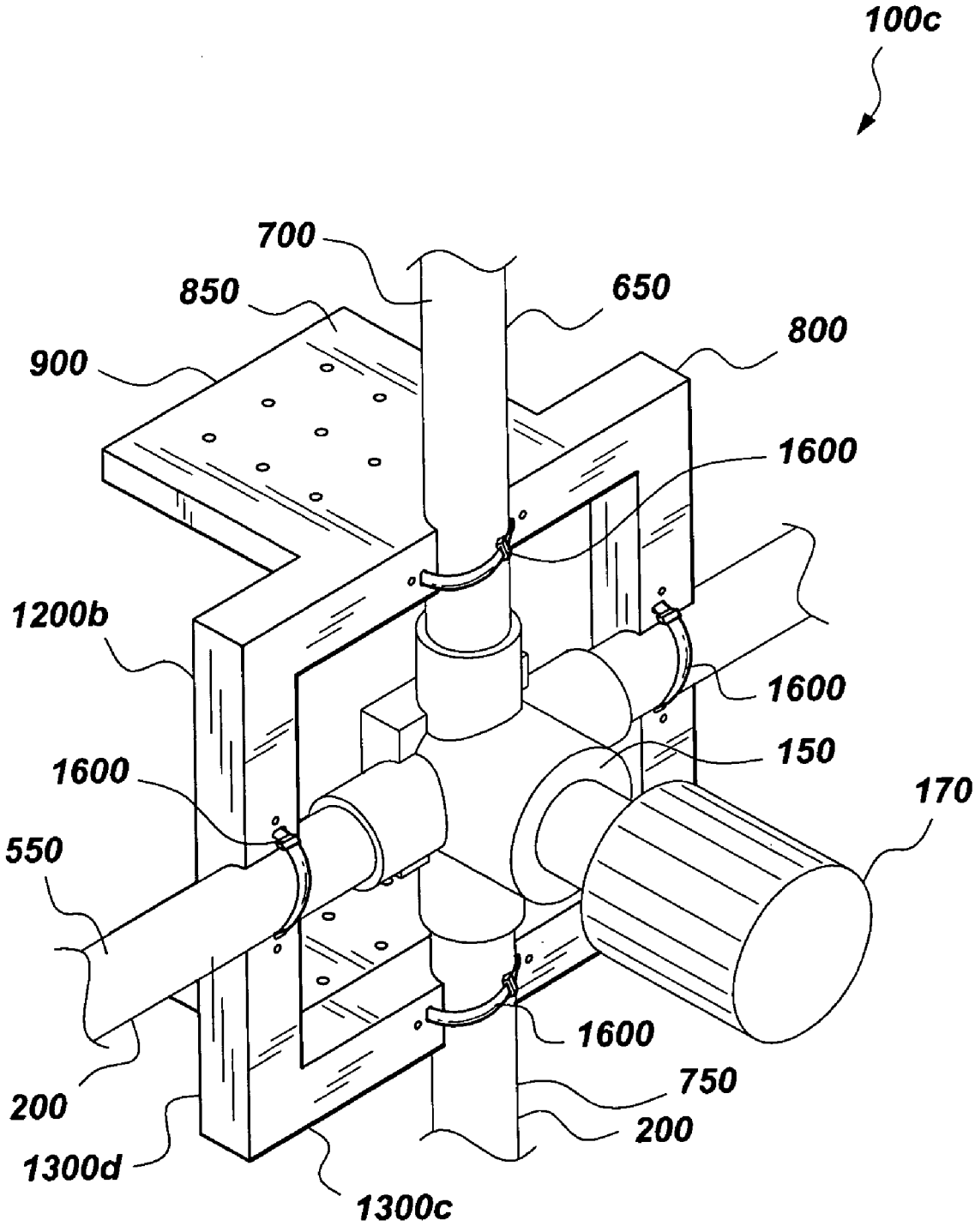
FIG. 3 shows an environmental, perspective view of another embodiment of the present invention.

FIG. 3 shows an environmental, perspective view of the second embodiment of the invention 100 (represented by alpha-numeric label 100*c*). Bracket system 100*c* comprises base bracket 800 in combination with ties 1600. Ties 1600 are used to secure associated water pipe hardware 200, and thus single-lever-valve 150 connected to associated water pipe hardware 200, to base bracket 800 and thence to support board 300. More specifically, each first 1400*a*, second 1400*b*, third 1400*c* and fourth 1400*d* notches has first notch side 1650 with at least one notch aperture 1700 disposed therein, and second notch side 1750 with at least one notch aperture 1700 disposed therein. Thus, ties 1600 can be used to secure associated water pipe hardware 200 to base bracket 800 thus making top bracket 800' optional.

Figure 4A:
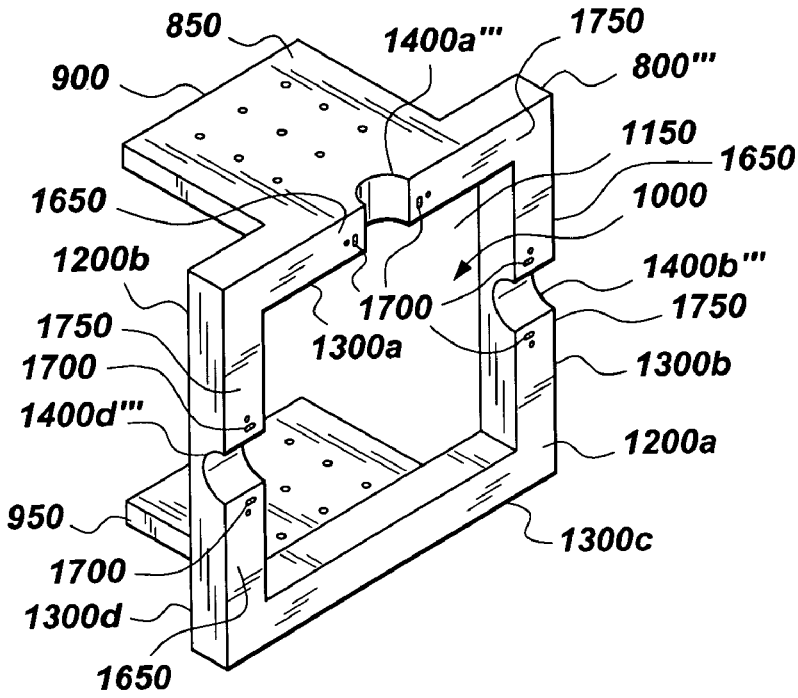
FIG. 4A shows another aspect of the present invention.

Referring to FIG. 4A, which shows a bracket 800 (actually represented by the numeric label 800'''); of particular note are the first 1300*a*, second 1300*b*, and fourth 1300*d* sides that respectively define just three notches: first 1400*a*''', second 1400*b*''' and third 1400*d*''' notches on first face 1200*a*, wherein each notch accommodates part of the circumference of a water pipe, wherein the notch of the second 1300*b* and fourth 1300*d* sides are commonly aligned.

Figure 4B:
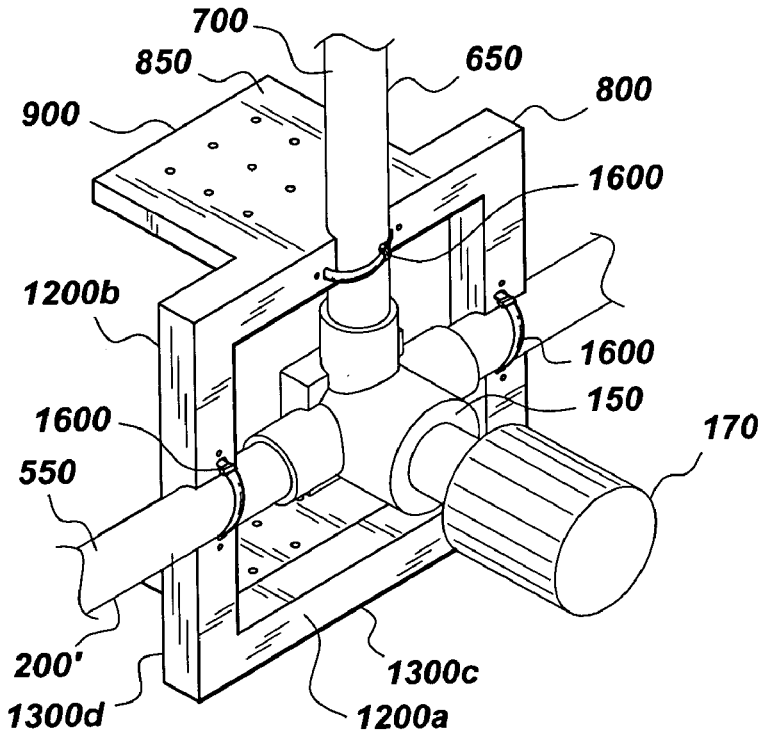
FIG. 4B shows another aspect of the present invention.
Figure 5:
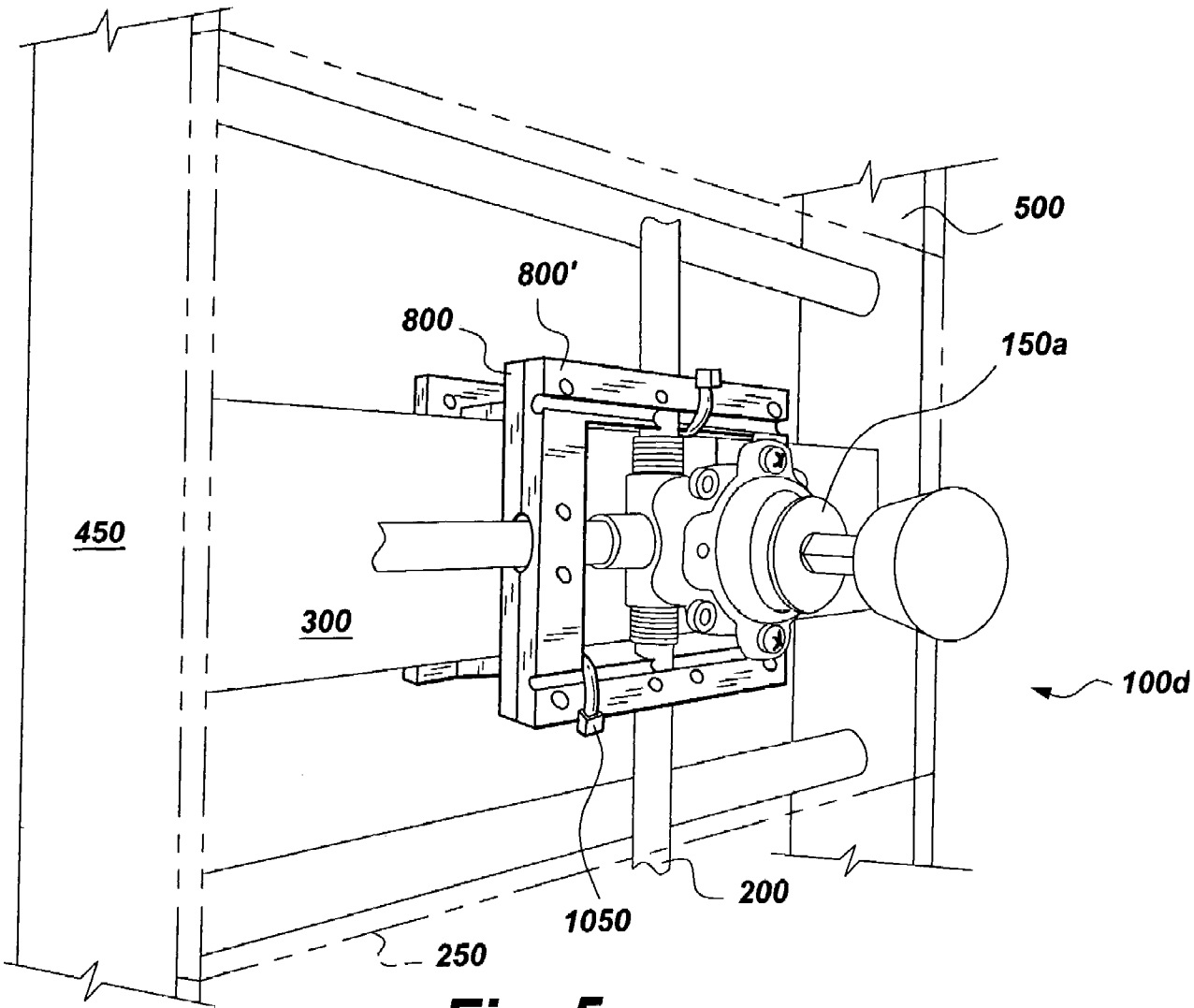
FIG. 5 shows another aspect of the present invention.

Referring to FIG. 4B, which shows associated water pipe hardware 200 (actually represented by the numeric label 200') fitted to face 1200*a* of first base bracket 800. More specifically, ties 1600 are used to attach the associated water pipe hardware 200' (and hence single-level-valve 150) to the front face 1200*a* of first base bracket 800.

Figure 7A:
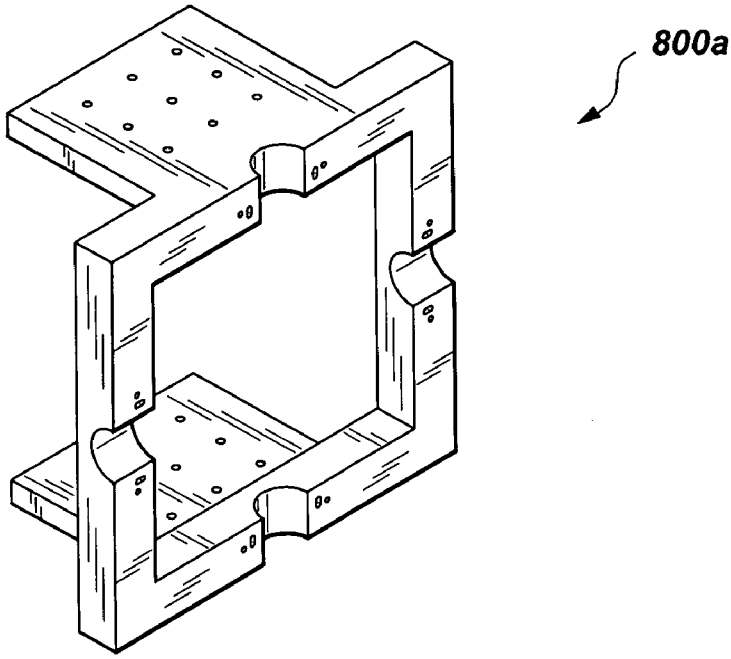
FIG. 7A shows another aspect of the present invention.
Figure 7B:
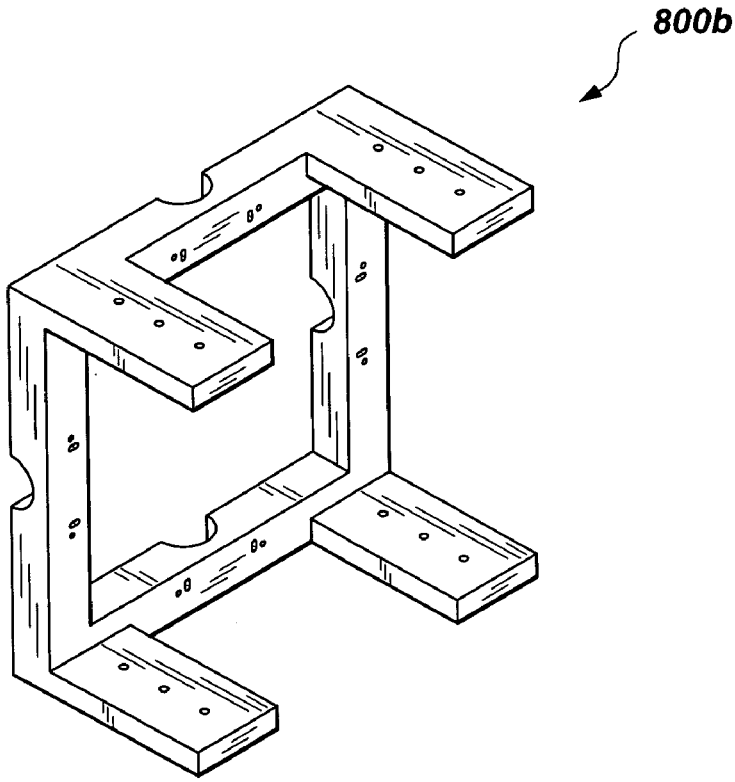
FIG. 7B shows another aspect of the present invention.
Figure 8A:
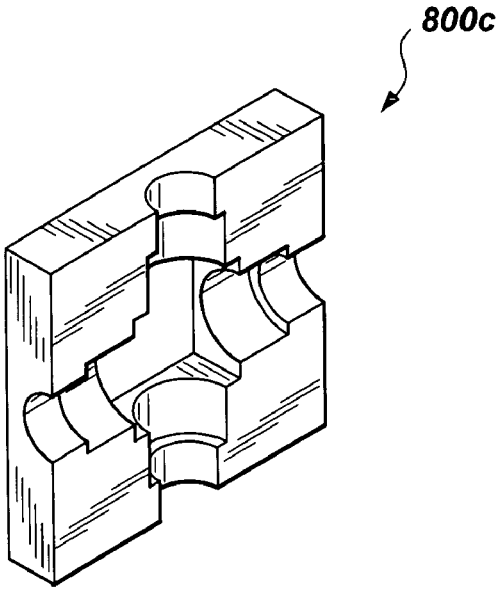
FIG. 8A shows another aspect of the present invention.
Figure 8B:
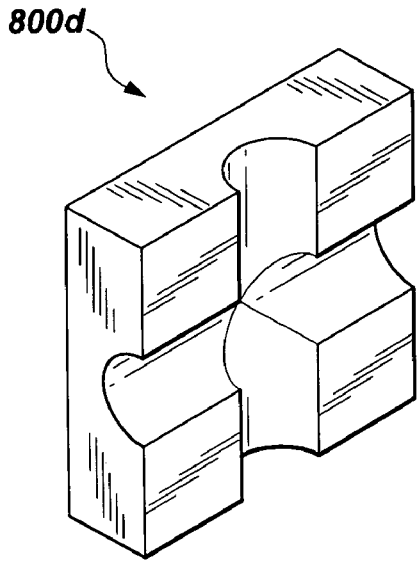
FIG. 8B shows another aspect of the present invention.
Figure 8C:
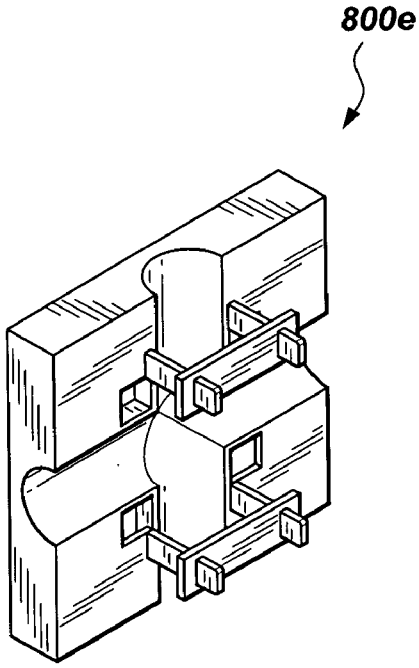
FIG. 8C shows another aspect of the present invention.
Figure 8D:
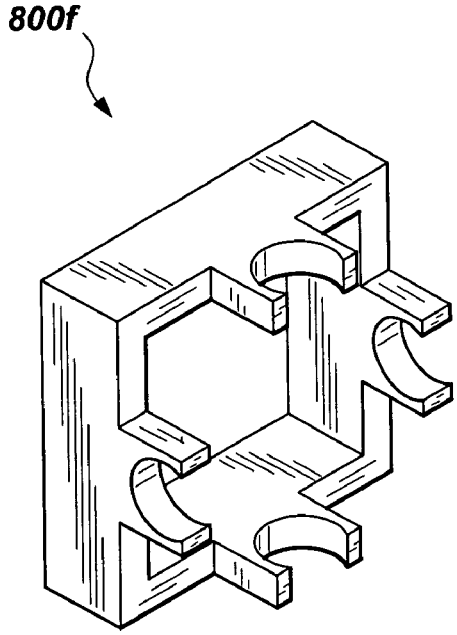
FIG. 8D shows another aspect of the present invention.
Figure 9A:
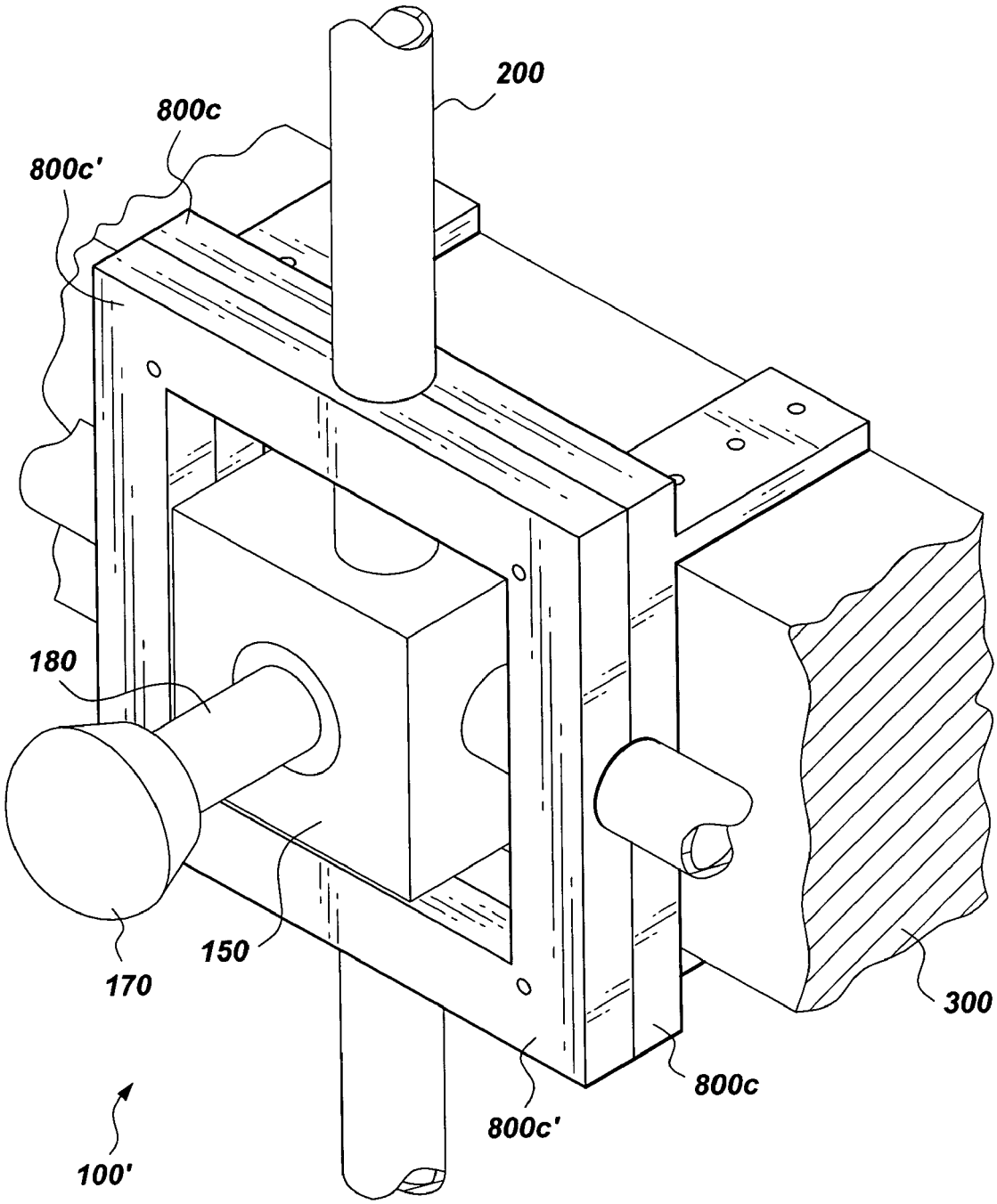
FIG. 9A is an environmental, perspective view of a further embodiment of a bracket system according to the present invention.
Figure 9B:
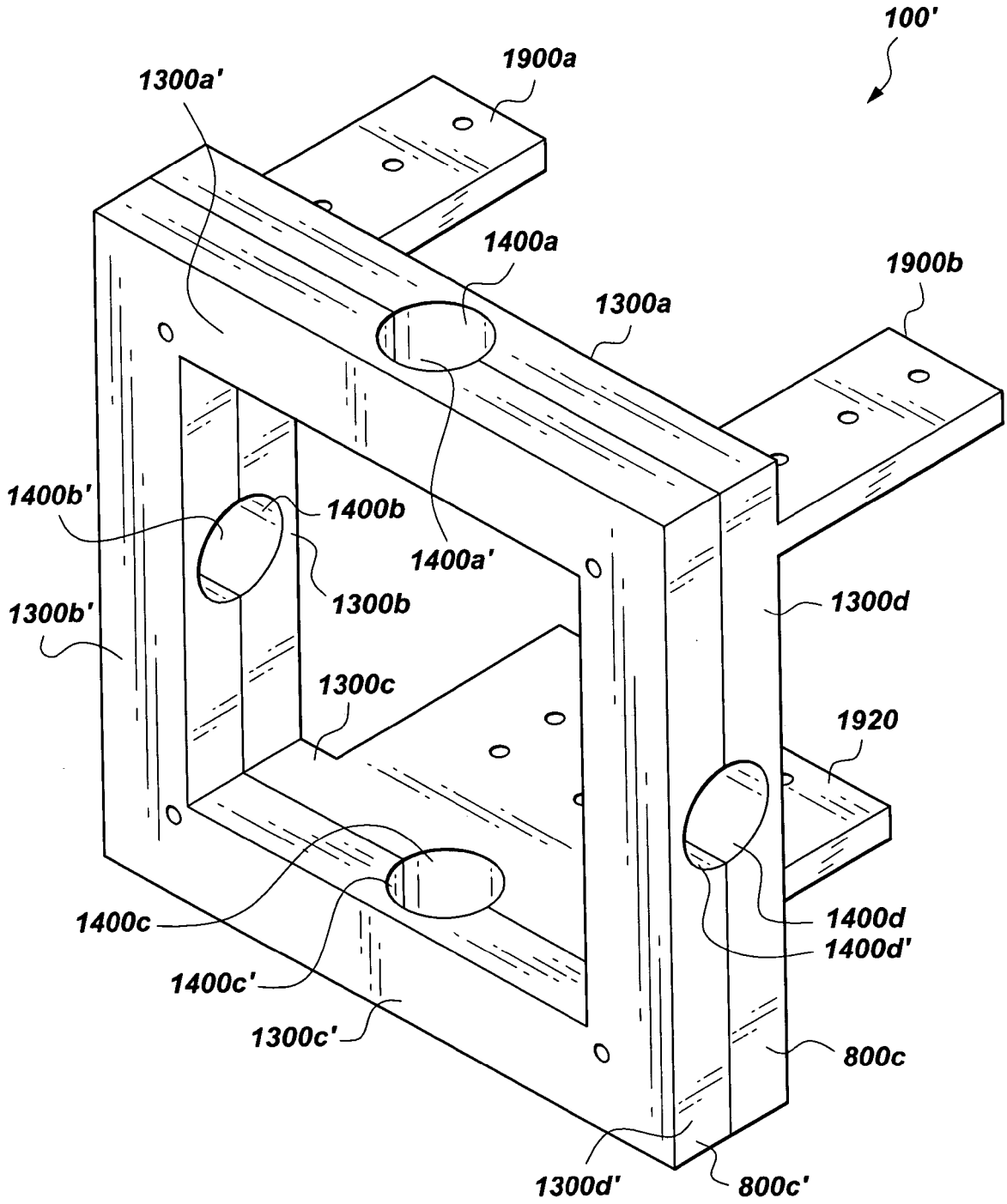
FIG. 9B is a perspective view of the bracket system of FIG. 9A.
Figure 9C:
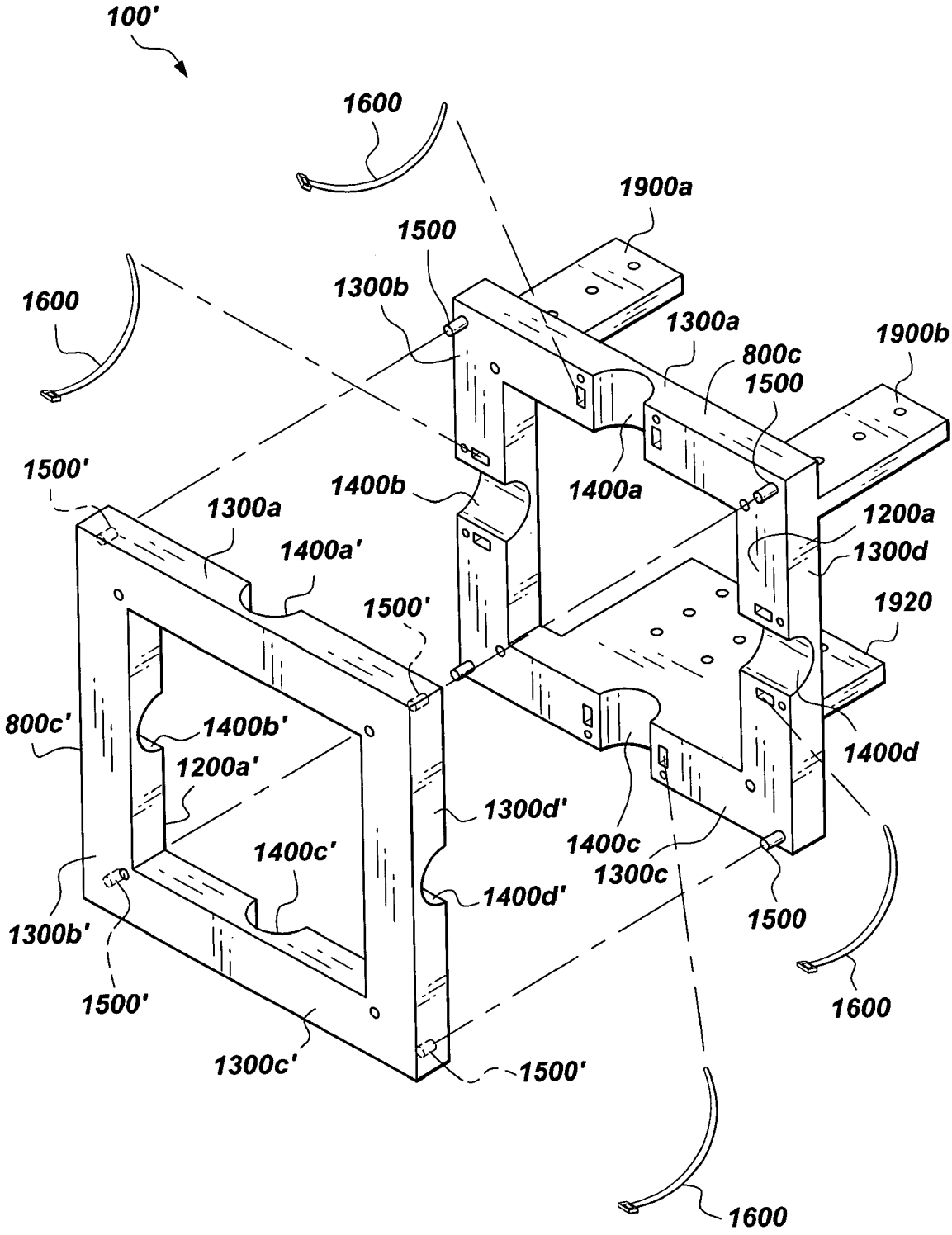
FIG. 9C shows an exploded view of the bracket system of FIG. 9A together with optional ties.
Figure 9D:
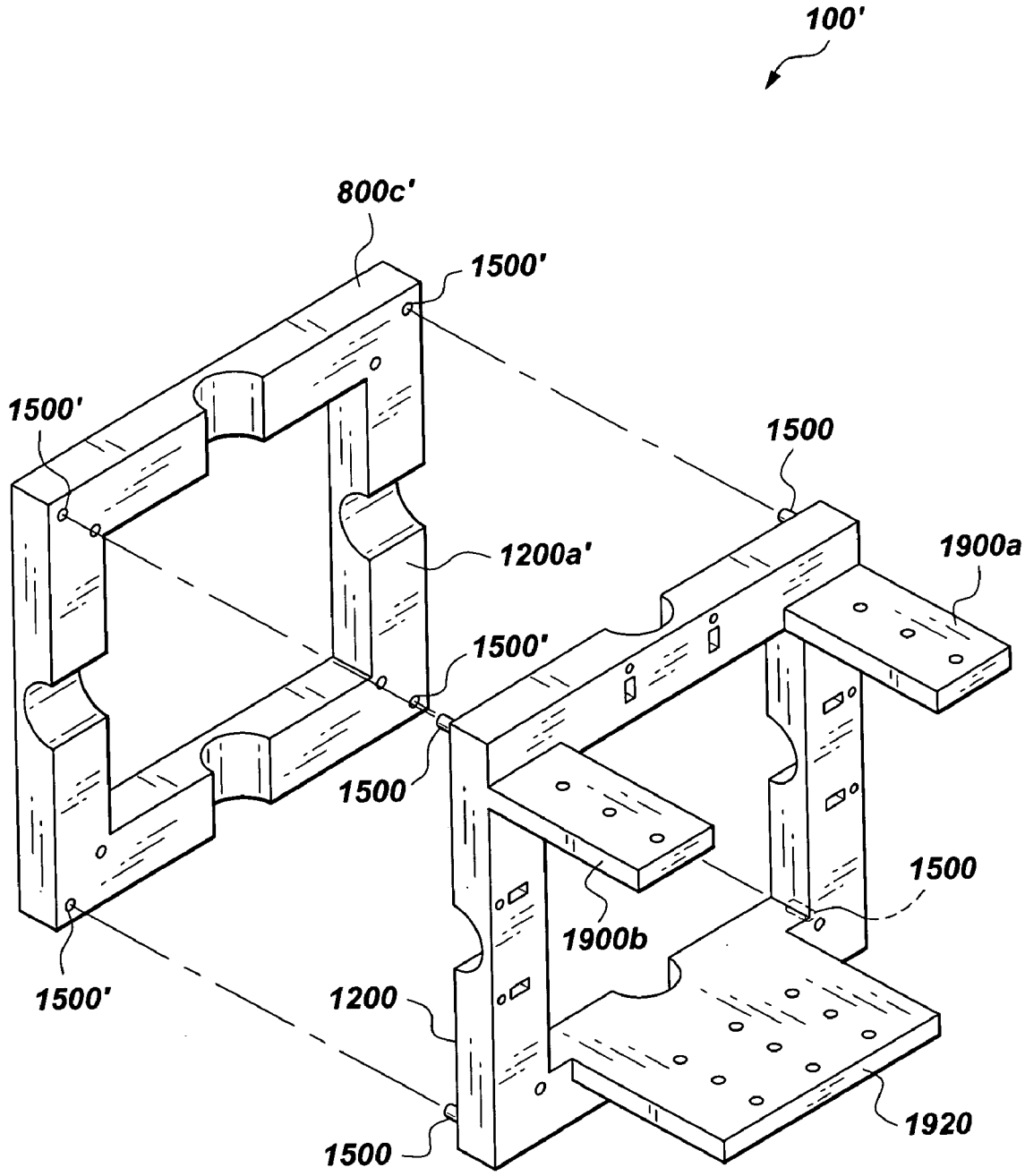
FIG. 9D shows an exploded view of the bracket system of FIG. 9A.

Referring to FIGS. 5 through 7B, FIG. 5 shows an environmental, perspective view of a further embodiment of the present invention. Specifically, the bracket system 100 (represented by alpha-numeric label 100*d*) is a back-to-back system for fitting first and second single-lever-valves 150*a* and 150*b* (shown in FIG. 6) to both sides of a support board 300. Of particular interest are the complementary base brackets, first base bracket 800*a* and second base bracket 800*b* which are configured to attach to the support board 300 without interfering with each other. FIGS. 7A and 7B show close up views of first and second base brackets 800*a* and 800*b*. It should be understood that base brackets 800*a* and 800*b* can each be used independently to attach the associated water hardware 200 and single-lever-valve 150 to support board 300 inside wall 250. Also, the ties 1600 can be used in place of top brackets 800*a*' and 800*b*' to secure the single-lever-valve 150 and pipe-work 200 to the base brackets 800*a* and/or 800*b*.

FIGS. 8A through 8D show alternative versions of base bracket 800 (represented by alpha-numeric labels 800*c*, 800*d*, 800*e* and 800*f*, respectively).

FIGS. 9A through 9D show a further embodiment in which a bracket system 100' comprises a first base bracket member 800*c* and complementary first top bracket member 800*c*'. The principle difference between bracket members 800 (shown in, e.g., FIGS. 1 and 2B) and 800*c* is that the first bracket member 800*c* comprises a pair of female tongues 1900*a* and 1900*b*, and a male tongue 1920. The male tongue 1920 is similar to member 900 or 950, whereas the female tongues 1990*a* and 1900*b* replace one of the members 900 or 950, and are spaced apart to accommodate tongue 1920, member 900 or member 950. Tongues 1900*a*, 1900*b*, and 1920 function as board attachment brackets for securing the bracket system 100' and single-lever-valve 150 and associated pipe work 200 to a support board 300.

It should be understood that the exact design of the base and top brackets 800*c* and 800*c*' can vary without detracting from the spirit of the invention. For example, male plugs 1500 and female plug inserts 1500' can be fitted in reverse. Specifically, the male plug members 1500 can be located on face 1200*a* or 1200*a*' and conversely female inserts 1500' on face 1200*a*' or 1200*a*, respectively. In addition, ties 1600 (shown in FIG. 9C) can be used to secure associated water pipe hardware 200 to base bracket 800*c* thus making top bracket 800*c*'. Alternatively, glue or any kind of suitable fastening system can be used in place of ties 1600 or members 1500 and 1500'. Ties could be used to tie the base 800*c* and optional top bracket 800*c*' together.

Figure 10A:
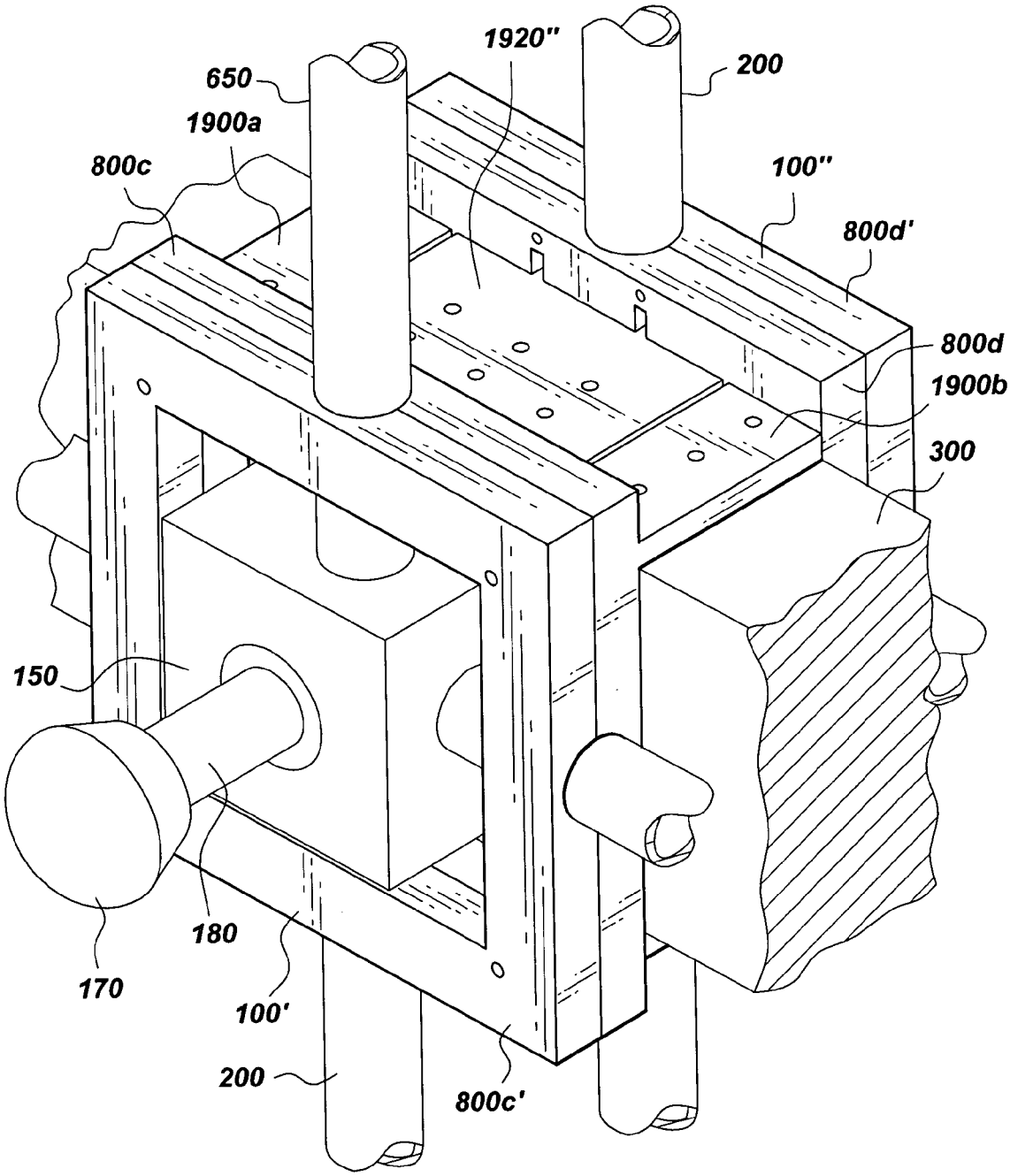
FIG. 10A is an environmental perspective view of a pair of brackets in a back-to-back configuration according to the present invention.
Figure 10B:
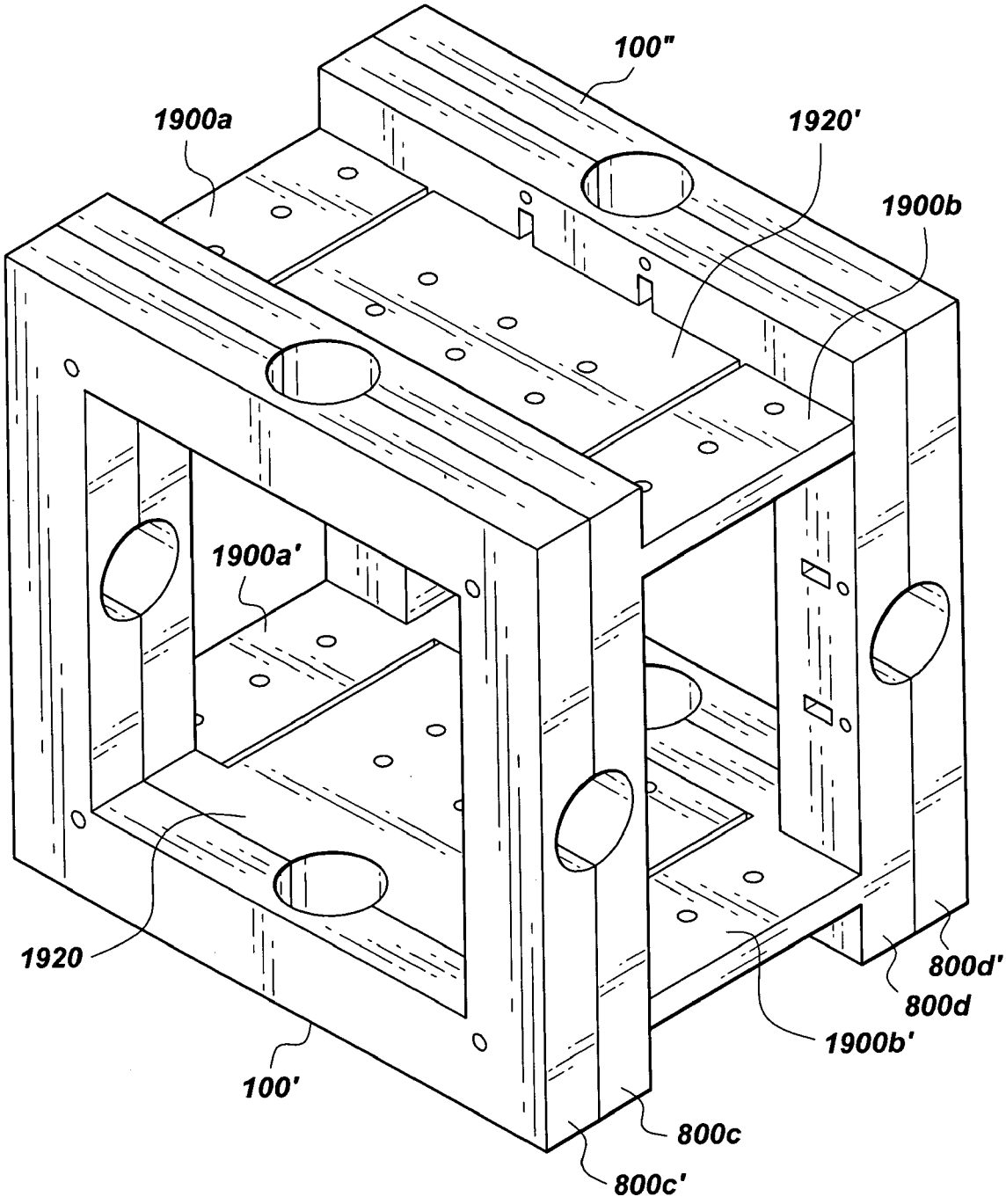
FIG. 10B is a perspective view of the bracket system of FIG. 10A.

FIG. 10A shows two brackets 100' and 100" configured to secure two single-lever-valves and associated pipe-work back-to-back to support board 300, wherein male tongue 1920" of bracket 100" fits between female tongues 1920*a* and 1920*b* of bracket 100'. FIG. 10B shows a perspective view of the bracket system 100' and 100" of FIG. 10A.

Referring to FIGS. 10A and 10B, brackets 100' and 100" are essentially the same brackets except that one of the brackets is rotated 180° with respect to the other. Specifically, brackets 800*c* and 800*d* are attach to the support board 300 such that the brackets 800*c* and 800*d* are upside down with respect to each other so that the male tongues 1920 and 1920' slot between the female tongues 1900*a* and 1900*b*, and 1900*a*' and 1900*b*', respectively. While top brackets 800*c*' and 800*d*' are shown in FIG. 10B, it should be understood that the top brackets 800*c*' and 800*d*' are optional, i.e., the top brackets can be replaced with ties 1600 or their functional equivalent. It should also be understood that the top brackets 800' and 800*b*' can be replaced with ties 1600 or their functional equivalent.

Figure 10C:
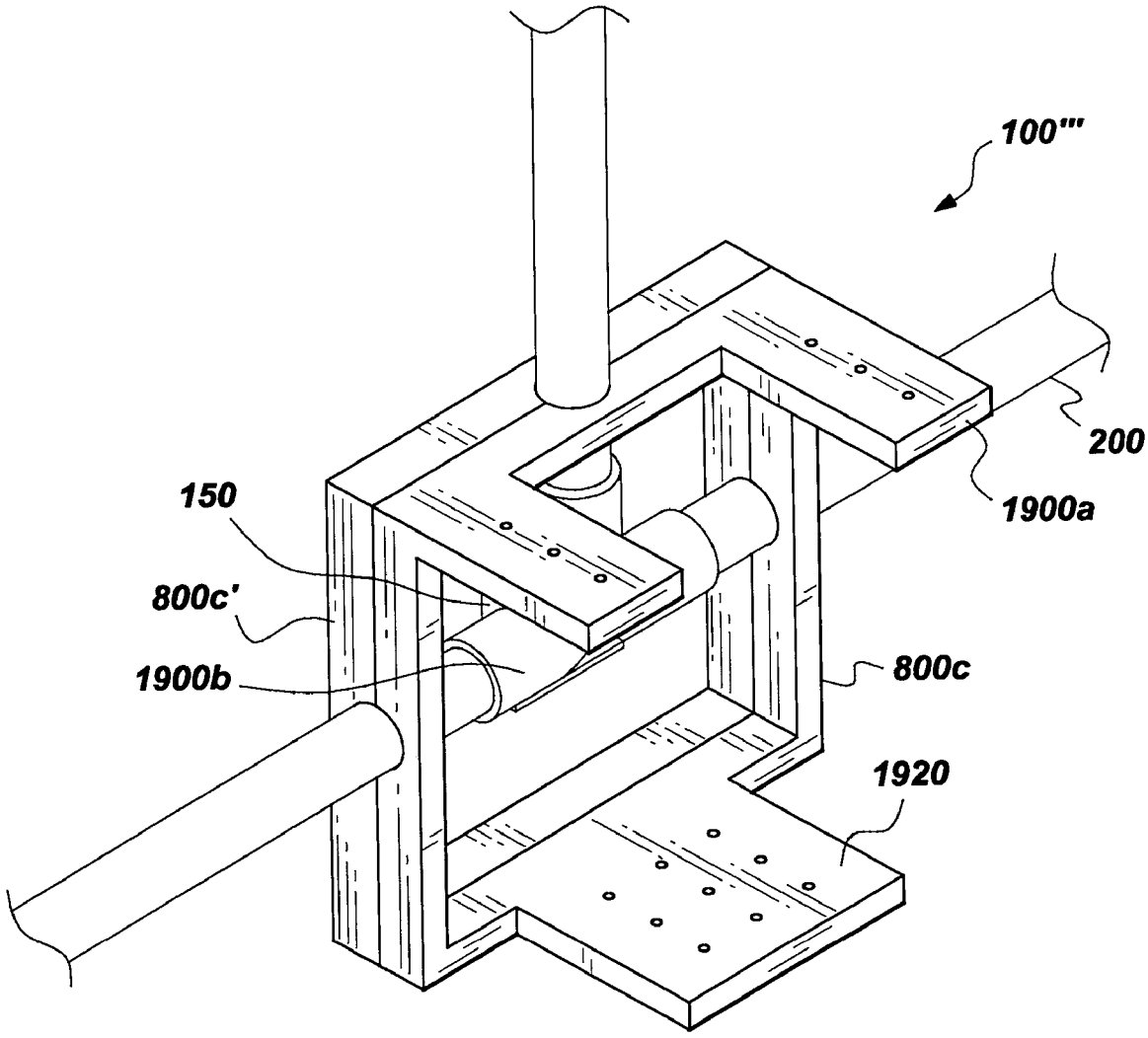
FIG. 10C is a perspective view of a bracket system according to the invention.

Referring to FIG. 10C, which shows a perspective view of a further embodiment of the present invention represented by bracket system 100'''. FIG. 10C shows brackets 800*c* and 800*c*' secured to each other and thereby enclosing water system 200 and single-lever-valve 150. In this example, the brackets 800*c* and 800*c*' comprise three complementary notch pairs.

It is to be understood that the present invention is not limited to the embodiments described above, but encompasses any and all embodiments within the scope of the following claims.

I claim:

1. A bracket system for securing two single-lever-valves back-to-back on opposite sides of a support board, comprising:

first and second base brackets each having first, second, third and fourth sides respectively defining first and second central spaces for accommodating a single lever valve in each central space, said first and second base brackets each having first and second opposite faces, wherein said first and third sides of each base bracket are parallel and opposite each other and said second and fourth sides of each base bracket are parallel and opposite each other, wherein each of said first, second and fourth sides of each base bracket comprises a notch on said first face, wherein each notch is sized to accommodate part of the circumference of a water pipe, wherein said notch of said first and third sides of each base bracket are opposite each other, and said notch of said second and fourth sides of each base bracket are opposite each other, each base bracket further comprising:

a male tongue for attaching to a support board, wherein said male tongue projects at a perpendicular angle from one side of said second face, wherein said male tongue defines board-securing apertures, a pair of female tongues, wherein said pair of female tongues project at a perpendicular angle from one side of said second face, wherein said pair of female tongues define board-securing apertures, wherein said male tongue is on the opposite side of said second face with respect to said pair of female tongues, wherein said male tongue of said first base bracket can fit between said pair of female tongues of said second base bracket, and said male tongue of said second base bracket can fit between said pair of female tongues of said first base bracket: and means for attaching water pipe hardware to notches on said first side of each base bracket.

2. The bracket system according to claim 1, further comprising ties, wherein said ties are used as said means for attaching water pipe hardware to notches on said first side of each base bracket.

3. The bracket system according to claim 1, further comprising top brackets (800*c*' and 800*d*'), which respectively fit over and complement said first and second base brackets, wherein said top brackets (800*c*' and 800*d*') are used as said means for attaching water pipe hardware to said notches on said first face of each base bracket.

* * * * *